United States Patent [19]

Ganz

[11] 4,083,163

[45] Apr. 11, 1978

[54] PACKAGE FORMING MACHINE

[75] Inventor: Robert H. Ganz, Saddle River, N.J.

[73] Assignee: Ganz Brothers, Inc., Bergenfield, N.J.

[21] Appl. No.: 734,876

[22] Filed: Oct. 22, 1976

[51] Int. Cl.[2] ..... B65B 21/24

[52] U.S. Cl. ..... 53/48; 53/210

[58] Field of Search ..... 53/48, 210

[56] References Cited

U.S. PATENT DOCUMENTS

| | | | |
|---|---|---|---|
| 3,577,866 | 5/1971 | Ehrenfried et al. | 53/210 X |
| 3,791,100 | 2/1974 | Monaghan | 53/210 X |

*Primary Examiner*—Travis S. McGehee

*Attorney, Agent, or Firm*—Diller, Brown, Ramik & Wight

[57] ABSTRACT

This disclosure relates to a package forming machine wherein one or more articles are packaged as a unit by the wrapping of a film of shrinkable plastics material thereabout, the plastics material being provided as a continuous web. The machine is particularly adapted to the packaging of plural containers arranged in plural rows. A particular feature of the machine is the provision of draw members to draw the film down between adjacent units with the draw members being carried by an endless conveyor for circulation in a plane which extends transversely of the path of movement of the article being packaged and slopes downwardly in the direction of movement of the articles. The plane of the draw members may be varied in accordance with the height of the articles whereby a basic machine may be adjusted to accommodate articles of different heights. The machine includes first and second conveyor means which are separated so as to permit the draw members to pass therebetween while maintaining full control over the articles passing through the machine. The machine is also provided with means for automatically cutting the drawn web, tucking a leading bottom web panel to an out-of-the-way position, moving a trailing bottom web panel under the containers, and then moving the leading bottom web panel into underlying relation to the trailing web panel so that a tight package may be automatically obtained.

28 Claims, 17 Drawing Figures

73
71
56
65
217
213
D
214
C
E
214
210
50
50
25
27
30
218
31
215
21
145
215
40
82
147
32
33
38
73
SEE FIG.15

73
76
73
75
74
84
83
80
73
77
78
81
85
87
86
210
210
73
88
210
90
95
102

77
86
97
73
91
96
93
98
90
95
76
88
82
94
92
203
205
78
197
200
206
201
103
102
104
101
100

77
73
Hb
107
74
78
73
82
205
220
221
105
222
223
α

77
73
71
Ha
107
74
78
73
82
205
220
221
105
222
223
α

PACKAGE FORMING MACHINE

This invention relates in general to new and useful improvements in package forming machines, and more particularly to a machine for wrapping one or more articles into a package utilizing a continuous web of plastics material and wherein the web is automatically wrapped around the article or articles being packaged and severed to form an individual package.

Package forming machines of the type utilizing a continuous web of plastics material are known. Attention is directed to my prior reissue U.S. Pat. No. Re. 28,535, granted Sept. 2, 1975. That machine has proven to function satisfactorily and is in commercial usage. However, the machine is a complex machine and requires separate construction of components of different height bottles and cans.

It is well known that in the packaging of various drinks, as well as other products, cans and bottles of different heights are utilized. For example, there are 7 ounce bottles, 8 ounce bottles, 10 ounce bottles, 12 ounce bottles and 16 ounce bottles, all of the same general class. In addition, there are cans which are approximately of the same diameter as the bottles, but are of different heights. Because of this, there has been a desire for a basic package forming machine which is capable of adjustment and modification with a minimal effort so that the same basic machine may be mass-produced and the variations made in the machine at the time of manufacture to accommodate the particular size container. Further, it is the desire of the industry to have a machine which can be adjusted and modified so as to change the usage thereof from one size container to another within limits.

In accordance with this invention, there has been provided a package forming machine wherein the web drawing means is mounted to operate in a plane extending transversely of the path of movement of the containers being packaged and sloping downwardly in the direction of container movement with the web drawing means being adjustable relative to the remainder of the machine so that the slope of the plane may be adjusted thereby permitting the same web drawing means to be utilized in conjunction with containers of different heights and under certain circumstances in conjunction with machines operating at different conveyor speeds.

In accordance with this invention, the web drawing means includes simply an endless conveyor having attached thereto in outwardly extending relation a plurality of draw members, the draw members circulating in the plane and being movable in spaced parallel relation down transversely of the container path. In each operation of a draw member, it traverses the path of the containers only once.

Other features of the machine include conveyor means for the containers wherein when containers arranged in two rows are packaged, a partial bottom panel may be engaged beneath the containers of the trailing row and then a complete bottom panel, which has been previously engaged beneath the containers of the leading row is passed under the partial bottom panel and then the wrapped containers are slid along a support wherein the full bottom panel is drawn rearwardly so as to tighten the package.

The machine is also provided with suitable conveyor means both for the supporting and movement of the containers and for pushing the units of containers along the predetermined path in a manner wherein complete control of the containers is maintained at all times and at the same time a draw member may pass transversely of the path through portions of the conveyors to effect the necessary drawing of the web down between adjacent groups of articles being packaged to provide the necessary bottom panels.

Another feature of the machine is that the wrapping of the web about the article or articles being packaged can be effective in a very short distance thereby reducing the linear extent of the machine with the resultant requirement of lesser space than was heretofore possible.

With the above and other objects in view that will hereinafter appear, the nature of the invention will be more clearly understood by reference to the following detailed description, the appended claimed subject matter, and the several views illustrated in the accompanying drawings.

IN THE DRAWINGS

Although the invention will be specifically described with respect to bottles which are arranged in two rows, it is to be understood that the package forming machine may equally as well be utilized in conjunction with not only cans and other types of containers also arranged in two rows, but other articles which are to be wrapped including a single article. As will be obvious from the following description, the package forming machine has particular use in conjunction with containers and like articles arranged in two rows with the articles moving along a path which extends transversely of the rows.

Figure 1:
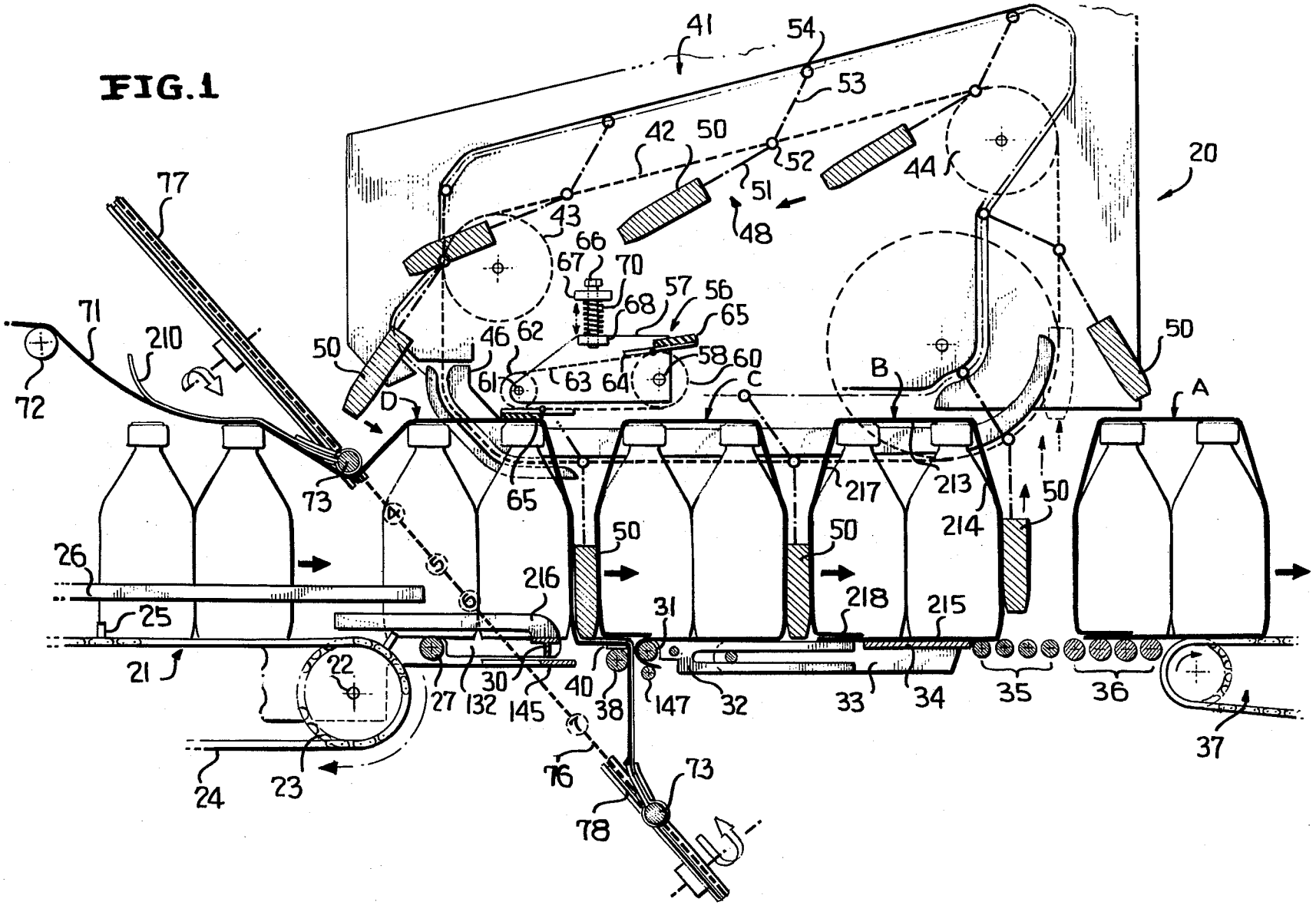
FIG. 1 is a schematic side elevational view showing the various components of the machine and the manner in which the web is drawn about articles being packaged.

With particular reference to FIG. 1, it will be seen that the article packaging machine is generally identified by the numeral 20 and includes a plurality of conveying means which define a path of movement. The conveying means are particularly adapted to convey articles such as bottles and cans although for the most part, the conveying means would also convey other articles including single articles of the same general cross-section as two of the illustrated bottles.

The conveyor means includes an infeed conveyor generally identified by the numeral 21. The conveyor 21 in and of itself does not form a part of this invention and therefore is only schematically illustrated. The conveyor 21 does include a shaft 22 having a plurality of sprockets 23 mounted thereon and these sprockets carrying endless chains 24. Carried by the chains 24 at predetermined spaced intervals are upstanding pusher pins 25. When the articles to be packaged are bottles and cans, there will be two pusher pins 25 pushing each of the bottles in the trailing row of bottles. It is also to be noted that associated with the conveyor 21 are suitable guide rails 26 which retain the bottles in alignment.

The bottles in the individual units of bottles when carried by the conveyor 21 are widely spaced, as is illustrated at the left of FIG. 1. The spacing between adjacent units may be greater than the diameter of the bottle.

Associated with the conveyor 21 is a driven support roll 27 which receives the bottles passing off of the conveyor 21. The support roll 27 is suitably supported relative to the conveyor 21 in a fixed position by means of support brackets 28 and is driven at the same peripheral speed as the conveyor 21.

The bottles pass from the support roll 27 onto a rear support 30 which is carried for movement longitudinally of the path of bottles by means of support arms 132 which are reciprocated in timed relation to the movement of the bottles thereover by a mechanism to be described hereinafter.

The bottles pass from the rear support 30 onto a forward support roll 31 which is carried by a plurality of transversely spaced fingers 32 which are mounted for reciprocating movement relative to a plurality of further fingers 33 with which they are intermeshed. The fingers 33 are fixed and are associated with a dead plate 34. The fingers 32 and the support roll 31 are reciprocated by a suitable mechanism which will be described hereinafter.

Downstream of the dead plate 34 is a plurality of idler rollers 35 followed by a plurality of driven rollers 36. The driven rollers 36 are driven at a peripheral speed so as to accelerate a wrapped package onto a conveyor generally identified by the numeral 37. The conveyor 37 normally is an infeed conveyor for a shrink tunnel (not shown) through which the packages pass for the purpose of both bonding together the plastics material and shrinking the same around the bottles.

The conveyor structure at the bottom of the article path also includes an oscillating support 38. The oscillating support 38 includes a plate-like support portion 40 which underly the bottles of the trailing row of each unit periodically in a position between the rear support 30 and the front support roll 31.

In order to push the bottles in units through the machine as a web of plastics material is wrapped around the units of bottles, there is provided a pusher unit, generally identified by the numeral 41. The pusher unit 41 includes a pair of endless conveyor chains 42 which are disposed on opposite sides of the path of travel of the bottles which are being packaged. Each conveyor chain 42 passes around sprockets 43, 44 and 45 which are arranged in sets on opposite sides of the path of movement of the bottles. In its lower portion of its travel, each conveyor chain 42 is guided by an upper guide bar 46 and a lower guide bar 47.

Extending between and carried by the conveyor chains 42 are a plurality of pusher bar units, each identified by the numeral 48. Each pusher bar unit 48 includes a pusher bar 50 carried by support arms 51 which are pivotally connected to the respective chains 42 as at 52. Rigidly connected to the support arms 51 are positioning arms 53 carrying cam followers 54. The cam followers 54 run in a cam track 55, there being one cam track 55 on each side of the path of the bottles. The positioning arms 53 in association with the cam tracks 55 position the pusher bars or members 50 as they pass along an endless path.

It is to be noted that each pusher bar 50 moves down between adjacent units of bottles and serve to push the units of bottles through the machine. Although the pusher bars 50 have been illustrated as also functioning as spacers, it is to be understood that the trailing unit of bottles need not be in contact with the rear side of the pusher bar advancing in front thereof.

In order that the web which is being wrapped about the bottles may be held in place during a subsequent web drawing operation, there is provided a clamp unit, generally identified by the numeral 56. The clamp unit 56 includes a suitable frame 57 which is pivotally mounted on a shaft 58 which also serves as a support for a pair of sprockets 60. The frame 57 carries a second shaft 61 on which a second pair of sprockets 62 are carried. Entrained around the sprockets 60, 62 are endless chains 63 which carry support bars 64. Associated with each support bar 64 is a resilient clamping pad 65 which is driven at a rate and an orientation to clampingly overly closures of the bottles of the leading row of each unit of bottles.

The frame 57 is mounted for limited vertical movement about the shaft 58 by means of fasteners 66 which extend freely through a support bar 67 and which have their lower ends fixedly positioned with respect to a bar 68. Encircling the fasteners 66 between the bars 67, 68 are coil springs 70 which resiliently retain the frame 67 in its lower position, but which permits the frame 57 to tip up at its left end, as viewed in FIG. 1, under compressive loading.

It is to be understood that the units of bottles are to be wrapped by means of a web 71 in the form of a film of plastics material. Preferably the plastics material is in the form of a heat shrinkable film. The web 71 passes from a roll (not shown) of the material over an idler 72 over the path of movement of the bottles so that the web overlies each unit of bottles at it passes into the wrapping area of the machine. As the unit of the bottles pass off of the conveyor 21, a draw member 73 engages the web and draws the same down between adjacent units of bottles and therebeyond in a manner to be described hereinafter. The draw member 73 moves down below the path of the bottles a distance sufficient to draw additional of the web 71 to form a partial bottom panel and a substantially full bottom panel of the package wrap to be described hereinafter.

Figure 8:
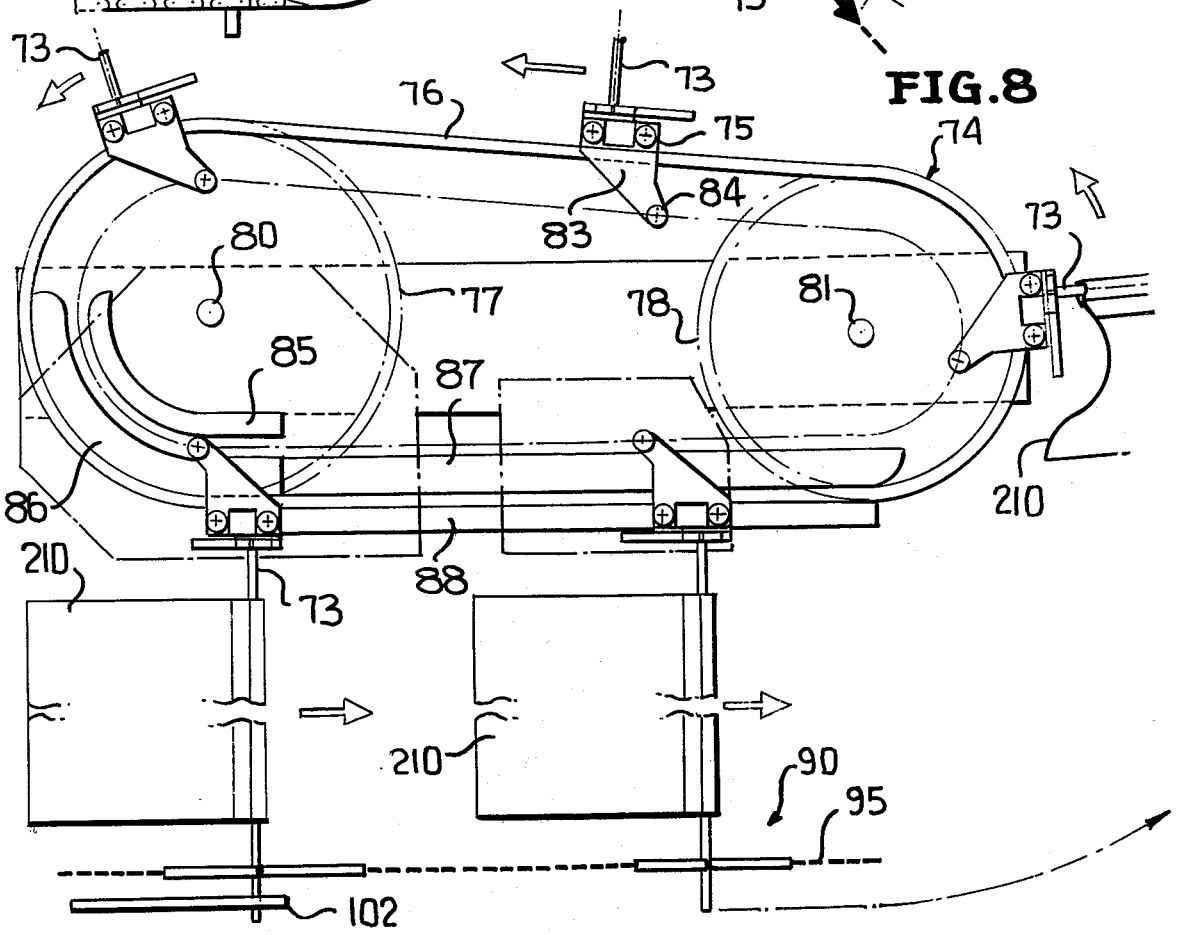
FIG. 8 is a schematic plan of the web drawing means and shows the general details thereof.

Referring now to FIG. 8, it will be seen that the draw member 73 is one of a plurality of draw members of a web drawing unit generally identified by the numeral 74. Each draw member 73 is carried by a bracket 75 which, in turn, is carried by an endless chain 76 mounted on a pair of sprockets 77, 78. The sprockets 77, 78 are carried by shafts 80, 81, respectively, which are, in turn, carried by a suitable support frame 82.

The conveyor chain 76 circulates the draw member 73 in a continuous path in a plane with a portion of the path of the draw members 73 being a straightline portion sloping downwardly across the path of movement of the bottles, as is shown in FIG. 1. As each draw member 73 moves from a position above the path of the bottles to a position below the path of the bottles, it remains parallel to the web 71.

In order to stabilize the movement of each draw member 73 in its straightline path of movement, each bracket 75 is provided with a positioning arm 83 carrying a cam follower 84. The cam followers 84 engage suitable guides 85, 86 which are also carried by the support frame 82. Further, as the chain 76 passes along the straightline portion of the path of movement of the draw member 73, it is stabilized in a straightline path by means of a pair of guides 87, 88.

Figures 9, 10:
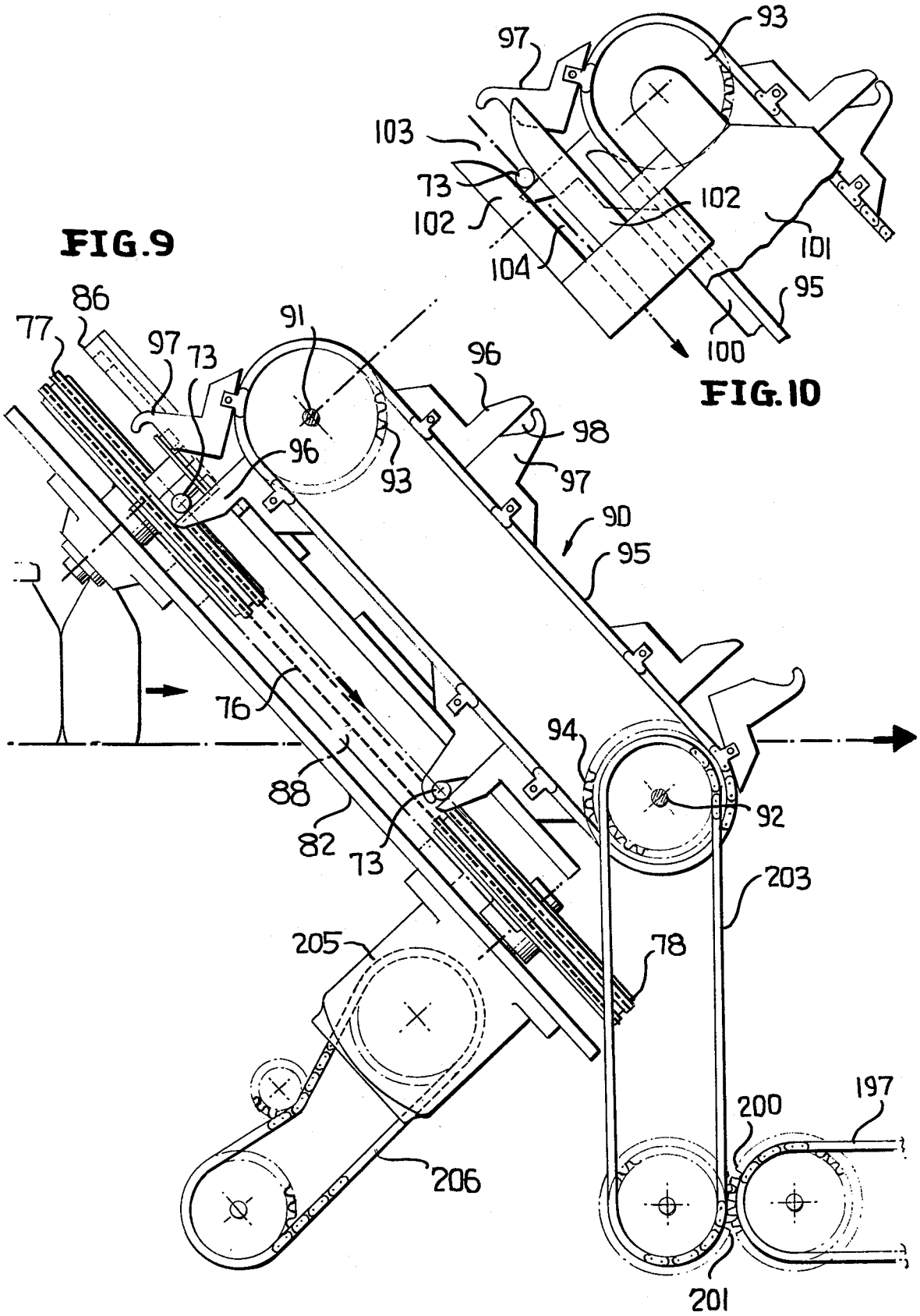
FIG. 9 is a schematic side elevational view showing further the details of the web drawing means including the support means for the draw members at the opposite side of the machine from the conveyor which carries the draw members.
FIG. 10 is a fragmentary showing of the support means and particularly illustrates the guide for moving the draw members into the supports therefore.

In order to further stabilize the parallel movement of the draw member 73, there is provided an auxiliary support unit, generally identified by the numeral 90, which is disposed on the opposite side of the path of the bottles from the chain 76. With reference to FIG. 9, it will be seen that the auxiliary support unit 90 includes a pair of horizontal shafts 91, 92 which carry sprockets 93, 94, respectively. Entrained over the sprockets 93, 94 is an endless chain 95 which, in turn, carries its spaced intervals cooperating support members 96, 97 which are individually mounted on the chain 95. It will be seen that as the support members 96, 97 pass around the sprocket 93, they separate which permits a descending draw member 73 to come into engagement with the trailing side of a support member 96 while the following support member 97 is out of alignment with the path of the movement of the draw member 73. However, as the support member 97 moves around the sprocket 93 and along the straightline portion of the path of the chain 95, it comes into abutment with the trailing side of the support member 96 and thus traps the draw member 73. It is to be noted that each support member 97 is provided with a notch 98 of a size to receive the draw member 73 snuggly.

It is also to be understood that, as is best illustrated in FIG. 10, the chain 95 along that straightline run portion thereof wherein the draw members 73 are engaged, is guided by means of a suitable guide 100 to assure its straightline movement. Further, it is to be understood that the auxiliary support unit 90 includes a suitable frame 101 which supports the shafts 91, 92, the guide 100 and the other components of the auxiliary support unit 90. These other components include a pair of guide bars 102 which are arranged in cooperating spaced relation so as to define an entrance 103 into a guide track 104 to assure the proper alignment of the end portion of a respective draw member 73 with respect to the support members 96, 97 to be associated therewith.

It is to be understood that the machine 20 includes a suitable frame 105 on which the various components of the machine are mounted in a conventional manner. The frame 105 supports a shaft 106 spaced well below the path of the bottles through the machine, the bottom of the bottle path being designated by the numeral 107. The shaft 106 is rotatably journaled in suitable supports 108 carried by the frame 105 and is driven by means of a sprocket 110 which, in turn, is driven from a main sprocket of the machine by a chain 111. The shaft 106 carries a cam 112.

A bell crank 113 is mounted on a pivot 114 carried by the frame 105 and includes a downwardly extending arm 115 and a forwardly, horizontally extending arm 116. The arm 115 is urged to the left by means of a spring 117 suitably anchored to the frame 105. The arm 115 carries a cam follower 118 which rides on the cam 112 and effects the movement of the arm 116 in a vertical plane.

The arm 116 is coupled by an adjustable link 120 to a crank unit 121 which is pivotally mounted on a pivot 122 carried by the frame 105 and which crank, in turn, carries the oscillating support 38 and its associated bar 40.

At this time it is pointed out here that there are two of the bell cranks 113, two of the adjustable links 120 and two of the cranks 121 with the oscillating support 38 extended between the cranks 121. The cranks 121 are disposed on opposite sides of the bottle path.

It is also to be understood that the shaft 106 and the cam 112 are rotated in timed relation to the movement of bottles along the bottle path so as to effect the swinging of the oscillating support 38 between its inoperative position and its operative position in timed relation to the movement of the bottles.

Figure 12:
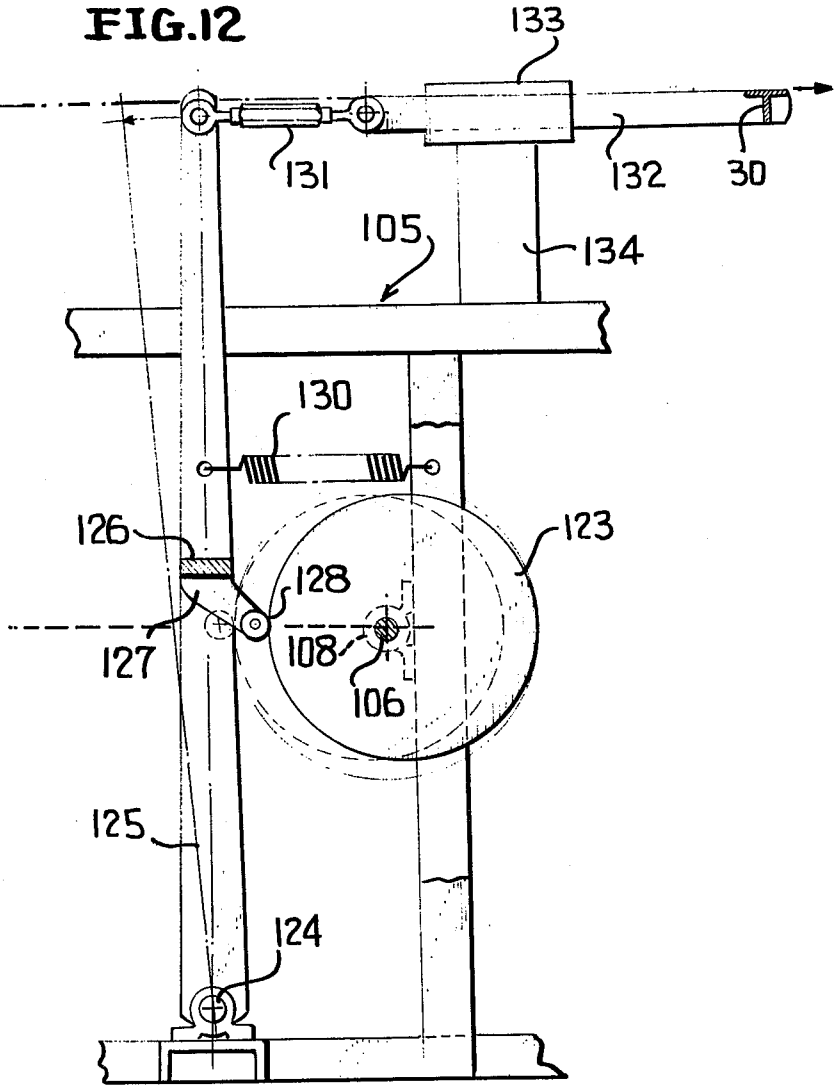
FIG. 12 is a schematic elevational view of the drive for a reciprocating support as referred to in FIG. 4.
Figure 11:
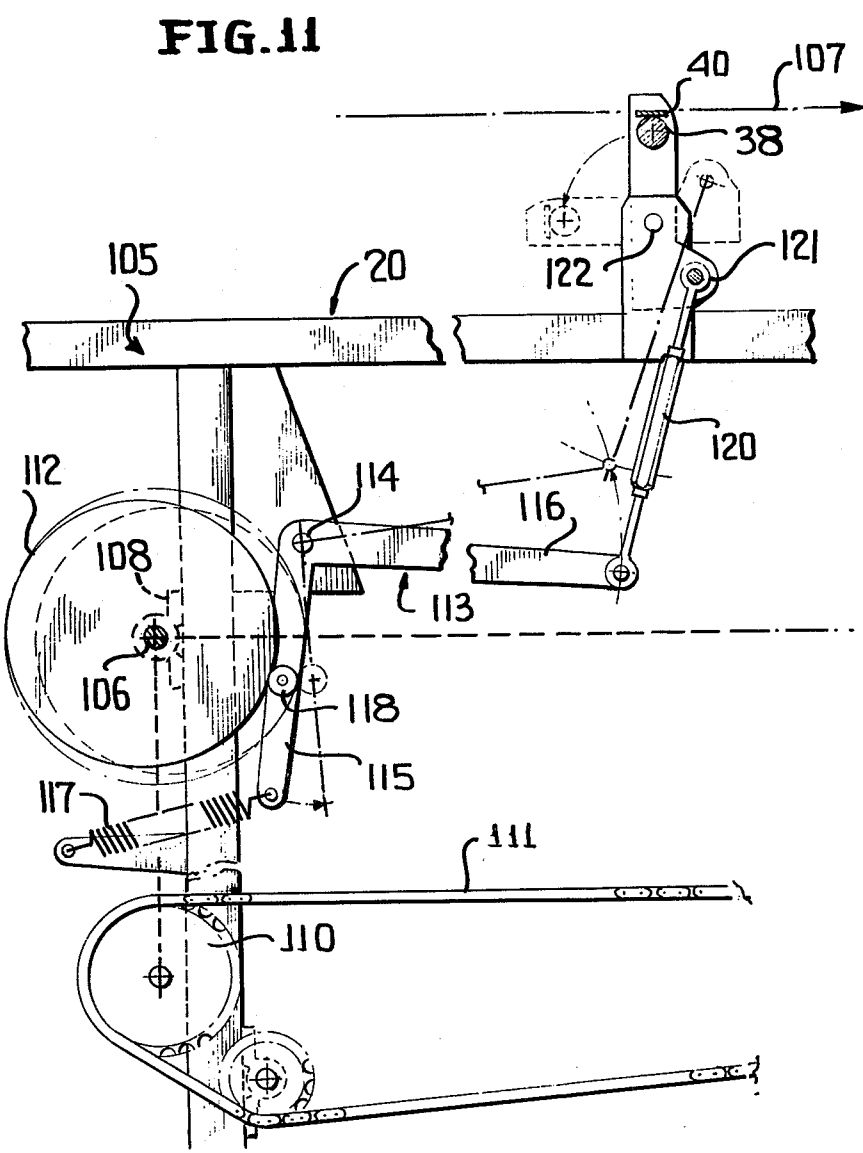
FIG. 11 is a schematic elevational view showing the details of the drive for an oscillating support as referred to in FIG. 3.

Referring now to FIG. 12, it will be seen that carried by the same shaft 106 is another cam 123. Pivotally carried by pivots 124 at opposite sides of the frame 105 is a pair of levers 125. The levers 125 are joined by a bar 126, which in turn, carries a bracket 127 which supports a cam follower 128 engaged with the cam 123. The cam follower 128 is urged against the cam 123 by means of a spring 130.

The upper end of each lever 125 is connected by an adjustable link 131 to a slide bar 132 which is slidably mounted in a guide 133 carried by a bracket 134 extending upwardly from the frame 105. Extending between the forward ends of the slide bars 132 for reciprocating movement therewith is the reciprocating rear support 30.

Figure 13:
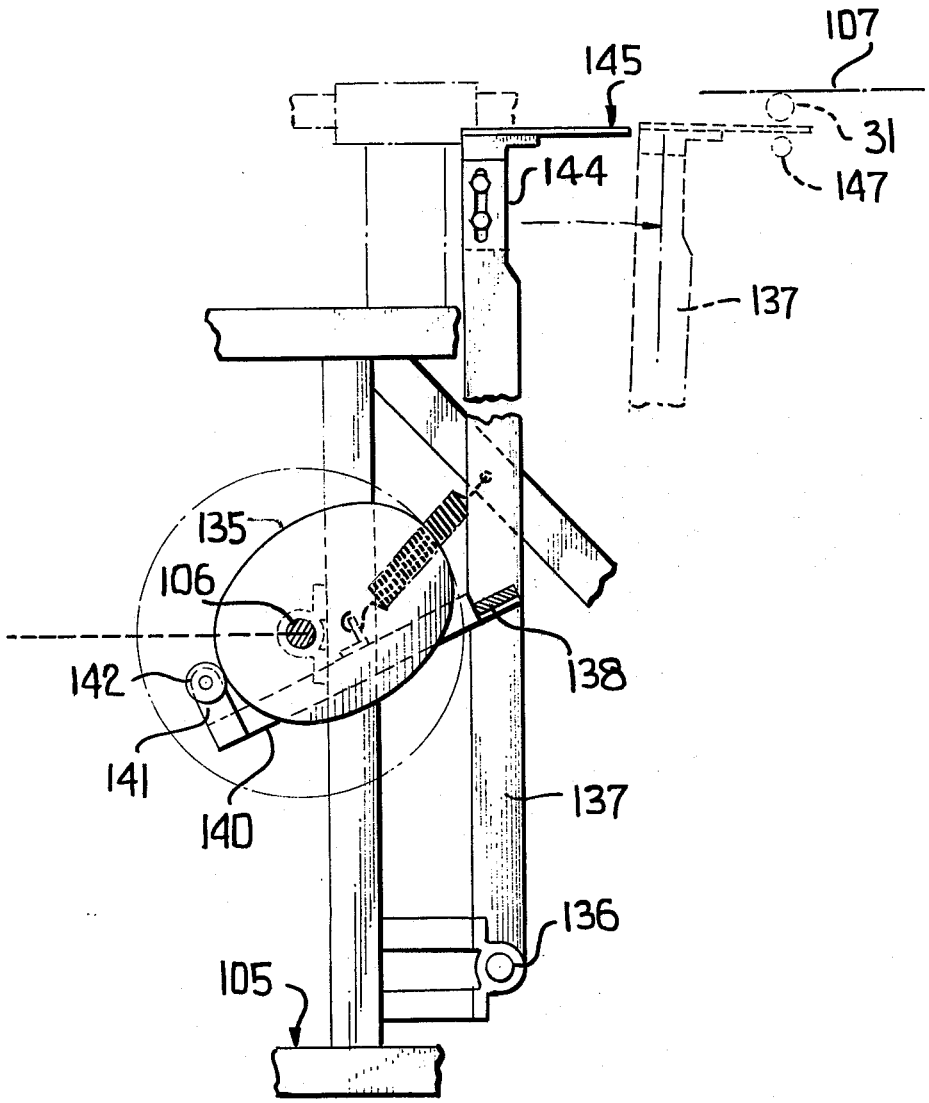
FIG. 13 is a schematic elevational view of the drive for a web tucker as indicated with reference to FIG. 5.

Referring now to FIG. 13, it will be seen that also carried by the shaft 106 is a cam 135. Also pivotally carried by pivot pins 136 mounted on the frame 105 at opposite sides of the path of the bottles are upstanding levers 137. The levers are connected together by a bar 138 which, in turn, carries a support bar 140 having mounted thereon a bracket for a cam follower 142 which engages the cam 135. The cam follower 142 is urged against the cam 135 by means of a spring 143.

At the upper end of each of the levers 137 is a bracket 144 and extending between the brackets 144 is a tucker blade or bar 145. As is schematically shown in phantom lines, the levers 137 are movable to the right to move the tucker bar 145 into the space below the front support roll 31 and an associated small bar 147. The function of these components will be described in more detail hereinafter.

Figure 14:
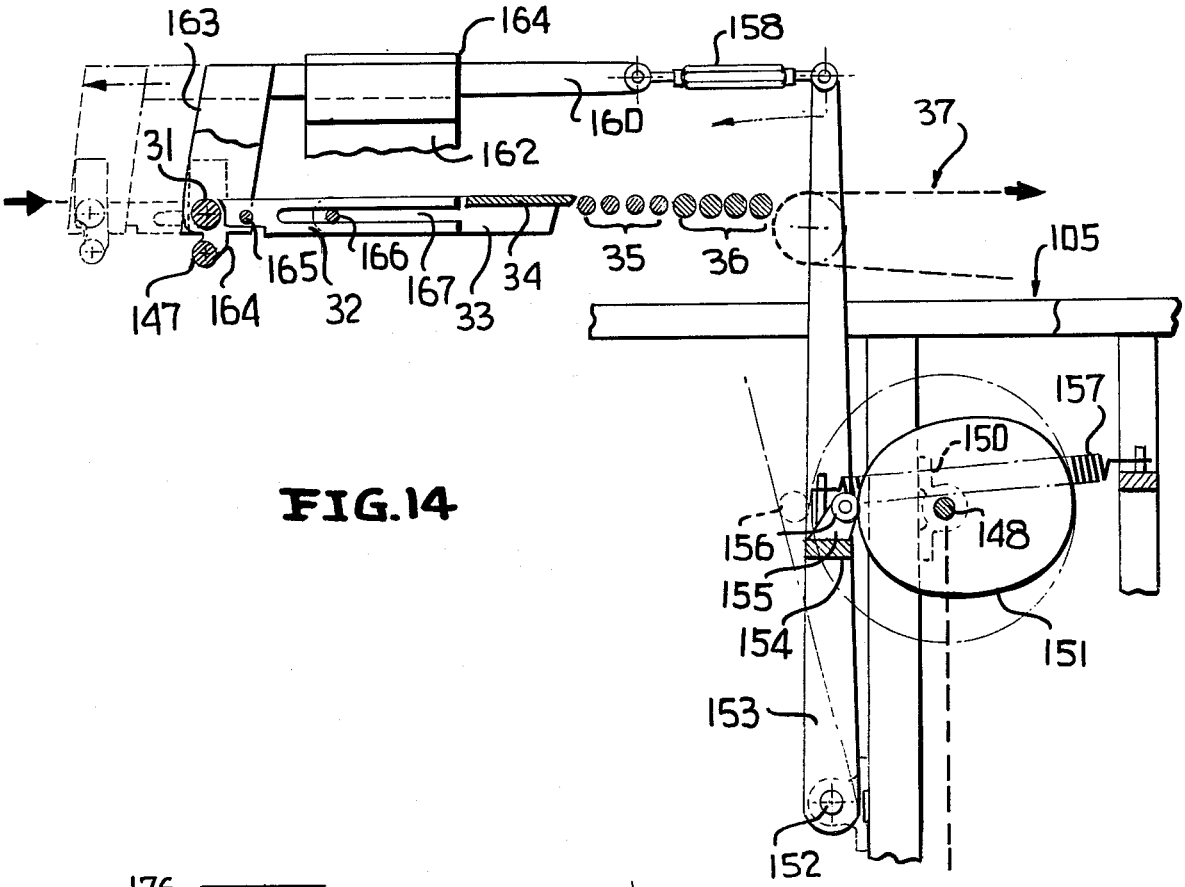
FIG. 14 is a schematic side elevational view of the mechanism for reciprocating the front support as referred to in FIG. 4.

Referring now to FIG. 14, it will be seen that the forward part of the frame 105 carries a main shaft 148 which is supported from the frame 105 by means of suitable bearing blocks 150. Carried by the shaft 148 is a cam 151.

Pivotally mounted on the frame 105 adjacent the lower portion thereof and at opposite sides of the path of movement of the bottles by means of pivots 152 are a pair of levers 153. The levers 153 are joined together by a transverse bar 154 which carries a bracket 155 with the bracket 155, in turn, carrying a cam follower 156. The cam follower 156 is resiliently urged against the cam 151 by means of a spring 157.

The upper end of each of the levers 153 has connected thereto a rearwardly extending adjustable link 158 which, in turn, is connected to a slide bar 160 mounted for guided reciprocatory movement within a guide 161, which, in turn, is mounted on the frame 105 by means of a bracket 162. The rear end of the slide bar 160 is provided with a depending bracket 163 and extending between the brackets 163 is the front support bar 31. The smaller bar 147 is connected to the brackets 163 by means of further brackets 164.

At this time it is pointed out that the fingers 32 are connected together at rear ends by a rod 165 which is also connected to the brackets 163. The rear ends of the fingers 32 are also connected together by means of a rod 166 and this rod is guidingly received in slots 167 in the forward portions of the fingers 32 so that the fingers 32 are supported for guided horizontal reciprocatory movement only.

Figure 15:
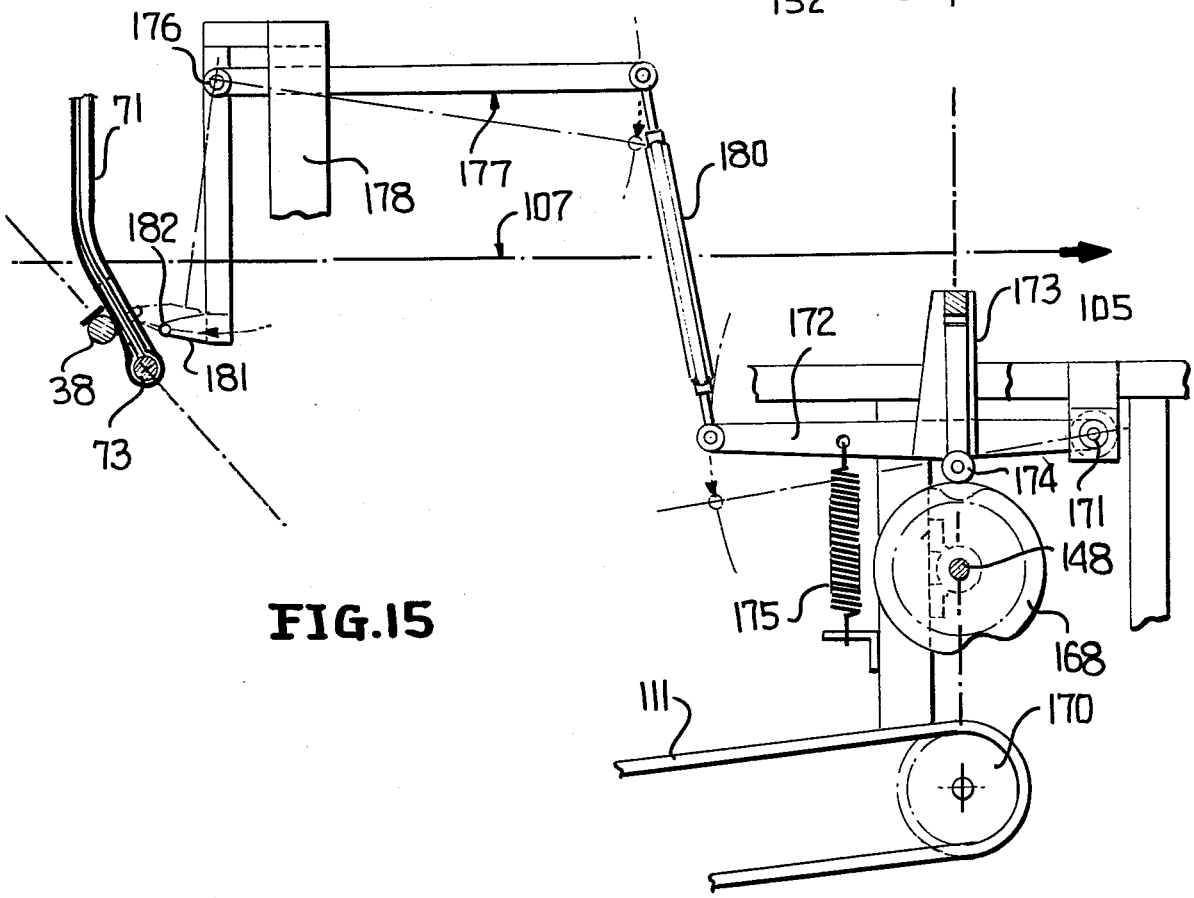
FIG. 15 is a schematic side elevational view of the mechanism for swinging the web cutter wire as referenced in FIG. 7.

With reference to FIG. 15, it will be seen that the shaft 148 also carries a cam 168. Further, the shaft 148 carries a driven sprocket of which the chain 111 is entrained so as to effect the driving of the shaft 106.

Carried by the upper part of the frame 105 and extending rearwardly from pivots 171 on opposite sides of the bottle path are horizontal levers 172. The levers 172 are connected together by a bracket 173 which carries a cam follower 174 engaged with the cam 168. A spring 175 holds the cam follower 174 engaged with the cam 168 at all times.

Suitably pivotally mounted on pivots 176 disposed on opposite sides of the bottle path are cranks 177. The pivots 176 are carried by suitable brackets 178 extending upwardly from the frame 105. One arm at each crank 177 is connected to an associated lever 172 by an adjustable link 180. The opposite arm of each crank 177 is provided with a bracket 181 and extending between the brackets 181 and supported thereby is a wire 182 which extends transversely of the bottle path below the bottle path in a position for engagement with the drawn web so as to sever the same. It is to be understood that the wire 182 may be heated in any desired manner so as to be sufficiently hot to automatically cut the web 71 when it engages the same, as is schematically illustrated in FIG. 15.

Figure 2:
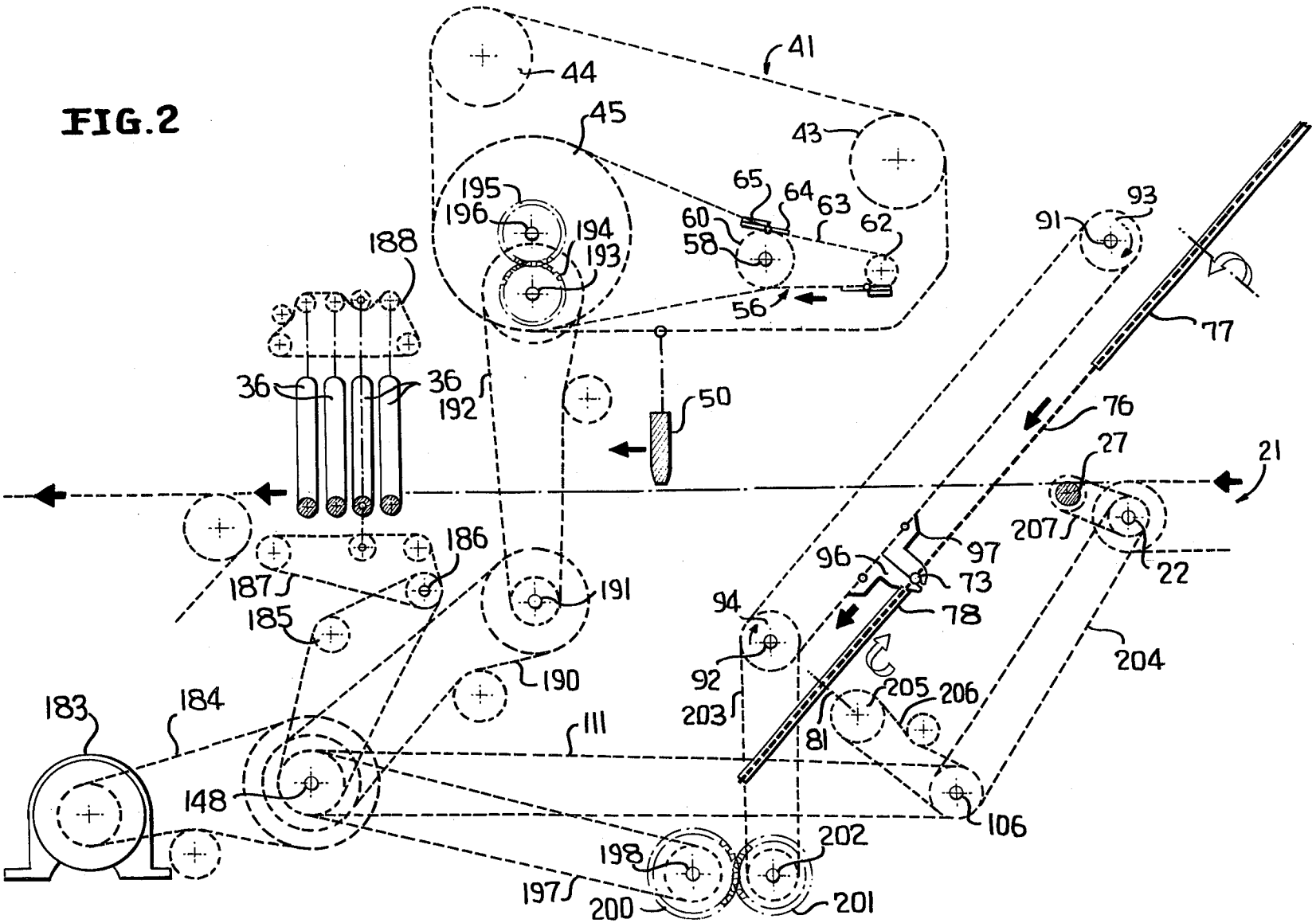
FIG. 2 is a diagrammatic view showing the drive for the various components of the machine.

Reference is now made to FIG. 2 wherein the general drive arrangement of the machine is schematically illustrated. The main drive shaft 148 is driven from a drive motor 183 by means of a chain and sprocket arrangement 184. A chain and sprocket arrangement 185 drives a shaft 186 from the main shaft 148. The shaft 186, in turn, drives a chain and sprocket arrangement 187 which, in turn, drives one of the driven rolls 36. A further chain and sprocket arrangement 188 drives the other three driven rolls 36 from the one roll.

A chain and sprocket arrangement 190 drives an intermediate shaft 191. A further chain and sprocket arrangement 192 drives a shaft 193 having thereon a gear 194 which is meshed with a gear 195 to drive a shaft 196. The shaft 196 supports and drives the sprockets 45.

Another chain and sprocket drive arrangement 197 drives a shaft 198 which has mounted thereon for rotation a gear 200 which is meshed with a gear 201 to drive a shaft 202. A chain and sprocket arrangement 203 drives the shaft 92 from the shaft 202.

The shaft 22 of the conveyor 21 is driven from the shaft 106 by means of a chain and sprocket arrangement 204.

Still another chain and sprocket arrangement 206 driven by the shaft 106 drives a right angle drive unit 205 of which the shaft 81 for the sprocket 78 is a part.

It is also to be understood that the power roll or driven roll 27 may be suitably driven from the shaft 22 by means of a belt 207.

It is to be understood that all of the various drive arrangements are so synchronized and of a drive ratio so as to drive the various components of the machine 20 in the proper direction, at the proper speed and in the proper timing.

Figure 3:
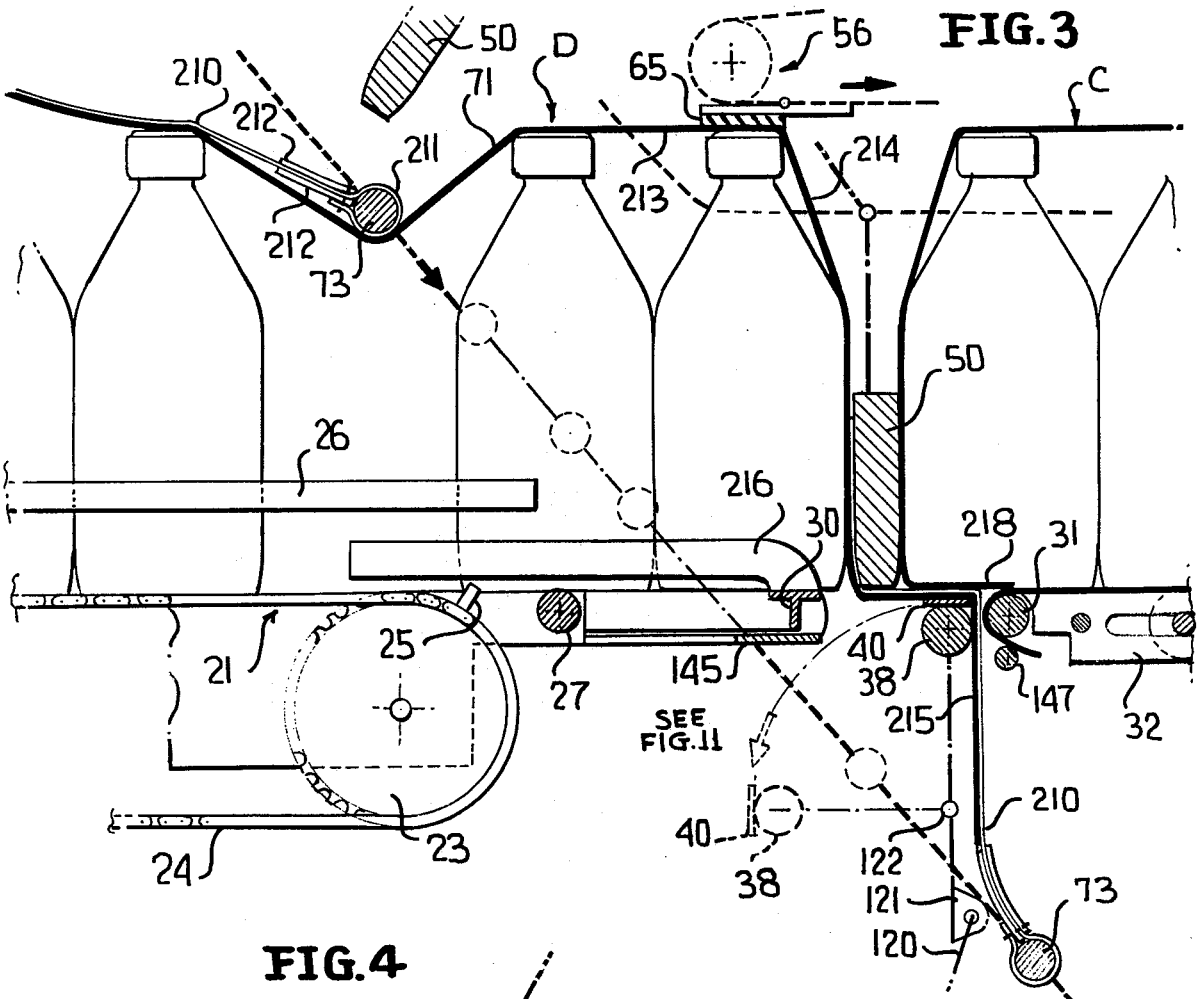
FIG. 3 is an enlargement of a portion of the diagrammatic view of FIG. 1 and shows more specifically the details of the machine.

Reference is now made to FIG. 3 wherein it is to be noted that each draw member 73 is provided with a trailing flag 210. The flag 210 is preferably formed of plastics material which is slightly heavier and stiffer than the web 71. The flag 210 has a loop 211 at one end thereof which is telescoped over the draw member 73.

The flag 210 also carries immediately adjacent the draw member 73 on opposite sides thereof strips 212 of asbestos material or other heat retarded material. The strips 212 are secured in place by stapling or other fastening means.

The operation of the invention can be best understood by reference to the showings of FIGS. 1 and 3–7. With particular reference to FIG. 1, it will be seen that a wrapped and tightened package A is being fed by the feed rolls 36 onto the conveyor 37 for delivery into the shrink tunnel (not shown). The package A has advanced away from the push bar 50 which was previously pushing the same so that the push bar 50 may move out of the path of movement of the bottles. A next following package, package B is primarily seated on the dead plate 34 and is being pushed thereacross onto the idler rolls 35 by the next following push bar 50. The package B is being tightened in a manner which will be described hereinafter.

The next package C is in a final stage of completion of the wrap and is primarily supported by the fingers 32 although the front support roll 31 and the oscillating support 38 are aiding in the support of the bottles of the trailing row of bottles.

The invention can be best described with respect to the formation of a package D and specific reference is made here to FIG. 3. It will be seen that the web 71 has already been drawn down between the bottles of package C and the bottles of package D and that the clamp pad 65 has clamped the web against the closures of the bottles of the leading row of bottles for the package D. At this time there has already been formed for the package D a top panel 213, a leading side panel 214, and a substantially full bottom panel 215. The bottom panel at this time is still under the influence of the oscillating support 38. An associated draw member 73 has started down between the trailing bottles of package D and the leading bottles of the unit which will be incorporated into what will become package E. The associated push bar 50 is still above the path of the bottles.

At this time it is to be noted that the rear support bar 30 has attached thereto in trailing relation a pair of side guides 216 which form continuations of the side guides 26 and prevent the movement of the bottles of the then being formed package transversely of the bottle path.

Figure 4:
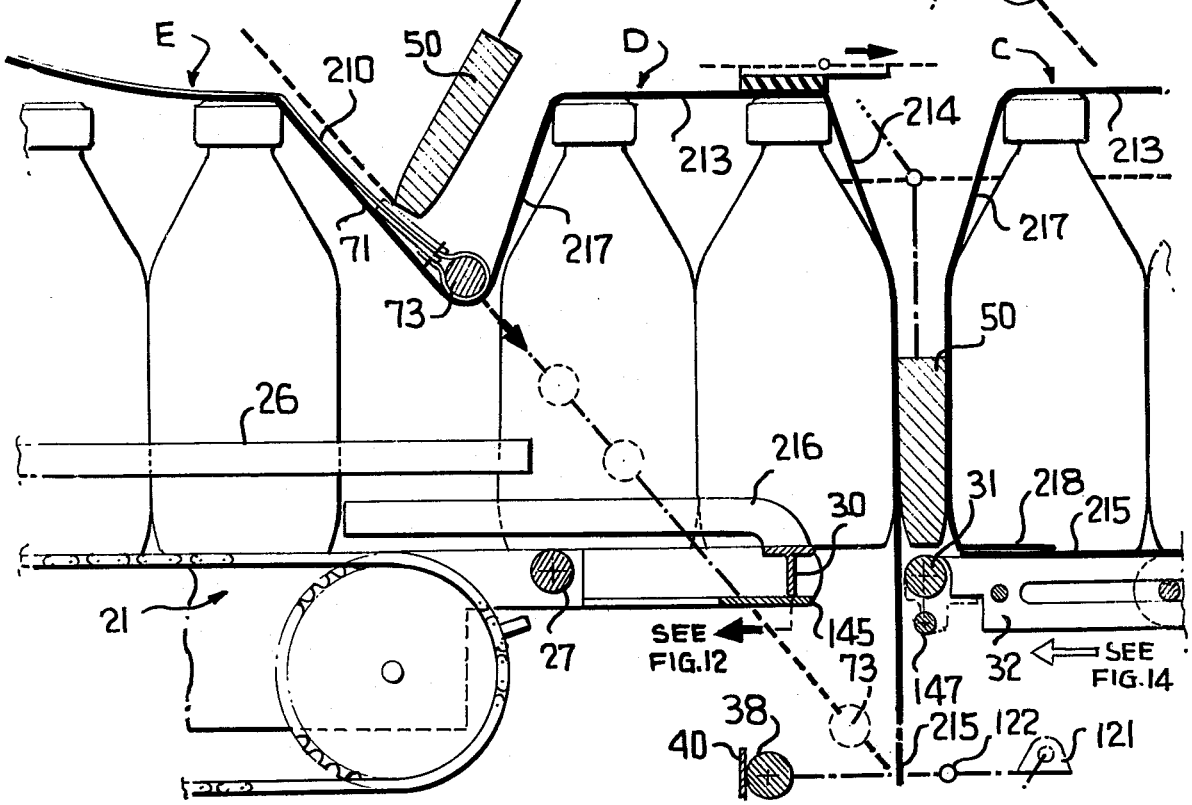
FIG. 4 is a diagrammatic view similar to FIG. 3 with the draw member in position 4 of FIG. 1.

Referring now to FIG. 4, it will be seen that the wrapping of package C has been completed. The oscillating support 38 has moved in a counter-clockwise direction to its rest position and has released the substantially full bottom panel 215 so that it depends vertically. The draw member 73 has moved down into the bottle path a substantial amount and has now drawn a portion of the web 71 down behind the trailing bottles of the package D to initiate the formation of a trailing side panel 217. The associated push bar 50 has also moved down into the path of movement of the bottles.

It is to be noted that the bottles of package D have moved to the right primarily under the influence of the drive roll 27 although the rear support 30 is moving to the right. It is to be noted that the bottles of the leading row of bottles of the package D have now slid partially across the rear support 30. It is also to be noted that the fingers 32 and the forward support roll 31, as well as the rod 147 have begun moving to the left and are approaching the depending substantially full bottom panel 215.

Figure 5:
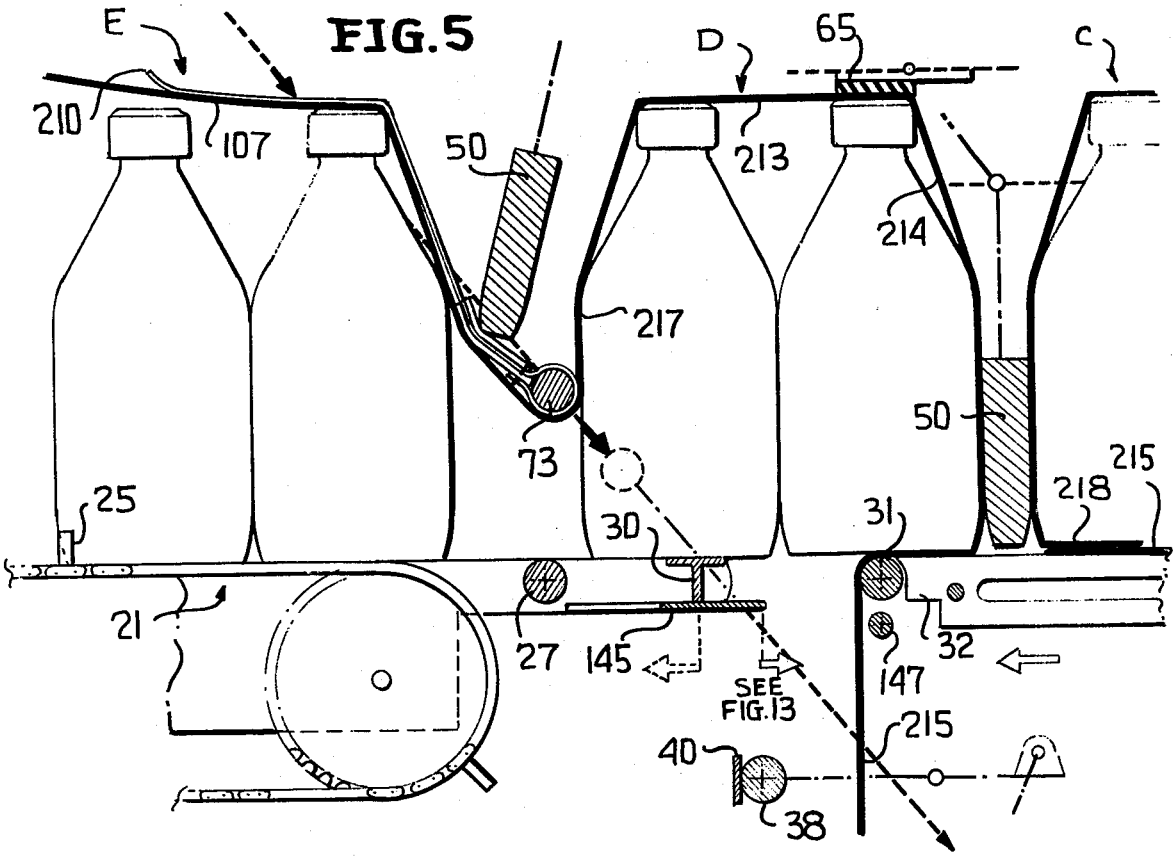
FIG. 5 is a diagrammatic view similar to FIG. 3 with the draw member in position 5 of FIG. 1.

Referring now to FIG. 5, it will be seen that the bottles of package D have advanced further to the right, the associated draw member has moved considerably down between the adjacent units of bottles, and the associated push bar has moved down closely behind the draw member. The leading row of bottles of package D have moved partially onto the fingers 32 and the front support roll 31 with the substantially full bottom panel 215 having been drawn under the forward portions of the bottles of the leading row of bottles of the package D. The bottles of the trailing row of bottles of package D are supported by the rear support 30 and the rear support 30 has almost reached its forward point of movement. At the same time, the fingers 32, the front support roll 31 and the rod 147 are moving rearwardly or to the left.

It is also pointed out at this time that the tucker blade 145 is now moving to the right and is advancing towards the space between the front support roll 31 and the rod 147.

Figure 6:
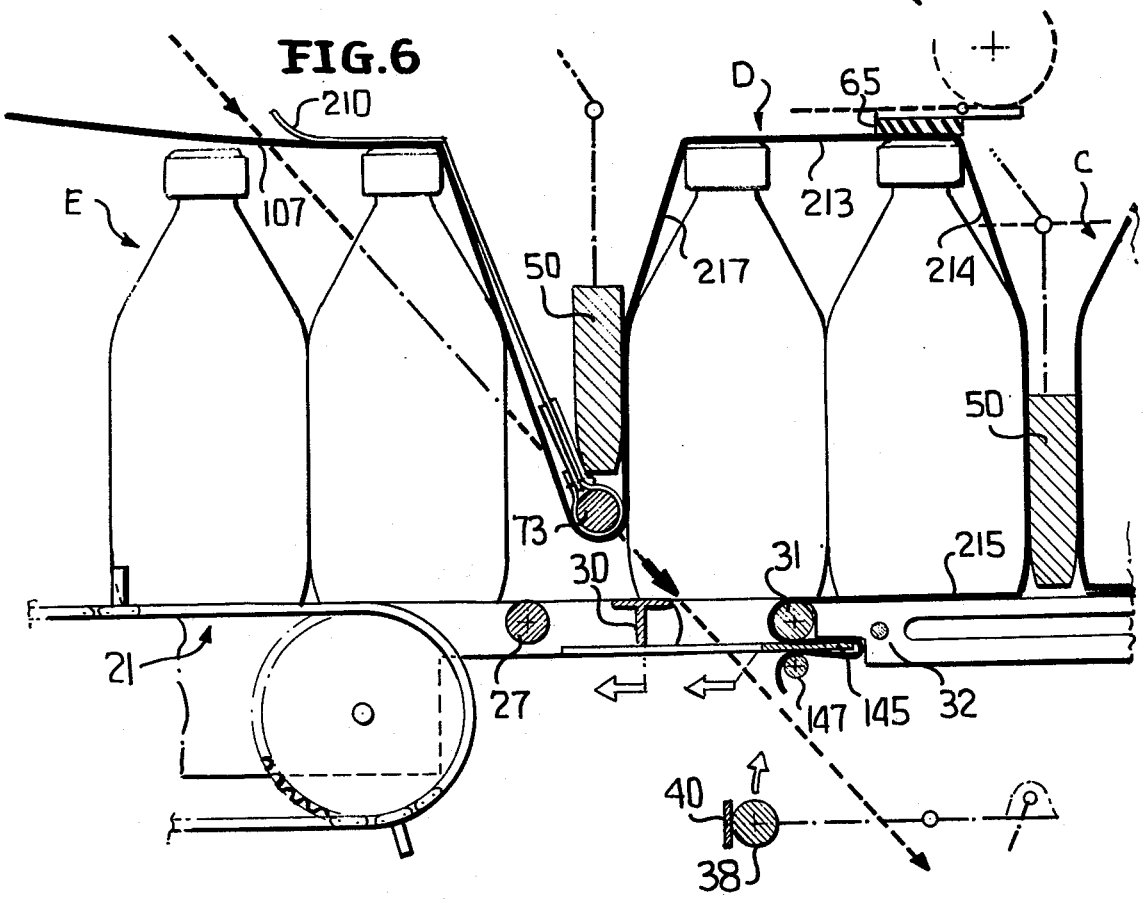
FIG. 6 is a diagrammatic view similar to FIG. 3 with a draw member in position 6 of FIG. 1.

Referring now to FIG. 6, it will be seen that the bottles of package D are under the influence of the push bar 50 associated therewith and that while the push bar 50 is still moving downwardly, it is moving to the right in a pushing action with respect to the bottles of package D.

The associated draw member 73 has moved downwardly towards the bottom of the bottles of package D. At this time the rear support 30 is moving back to the left and is about to move out of supporting engagement with the bottles of the rear row of bottles of package D. At the same time, the front support roll 31 has moved to the left while the bottles of package D have moved to the right so that it is moving into supporting engagement with the trailing row of bottles of package D. The leading row of bottles of package D are now seated on the fingers 32 and the substantially full bottom panel 215 has moved under the forward row of bottles of package D.

It is also to be noted that the tucker blade 145 has tucked the trailing portion of the substantially full bottom panel 215 in between the front support roll 31 and the rod 147. At this point it is to be noted that if it is necessary, suitable spring fingers may be provided for holding the tucked portion of the bottom panel 215 in its tucked position.

It is particularly pointed out here that at this time the rear support 30 is moving to the left towards the power roll 27. The tucker blade 145 is also beginning to move to the left to its returned out-of-the-way position. The fingers 32 and the front support roll 31 have begun moving to the right at approximately the same speed of movement as the bottles of package D. Finally, the oscillating support 38 has begun to swing upwardly.

Figure 7:
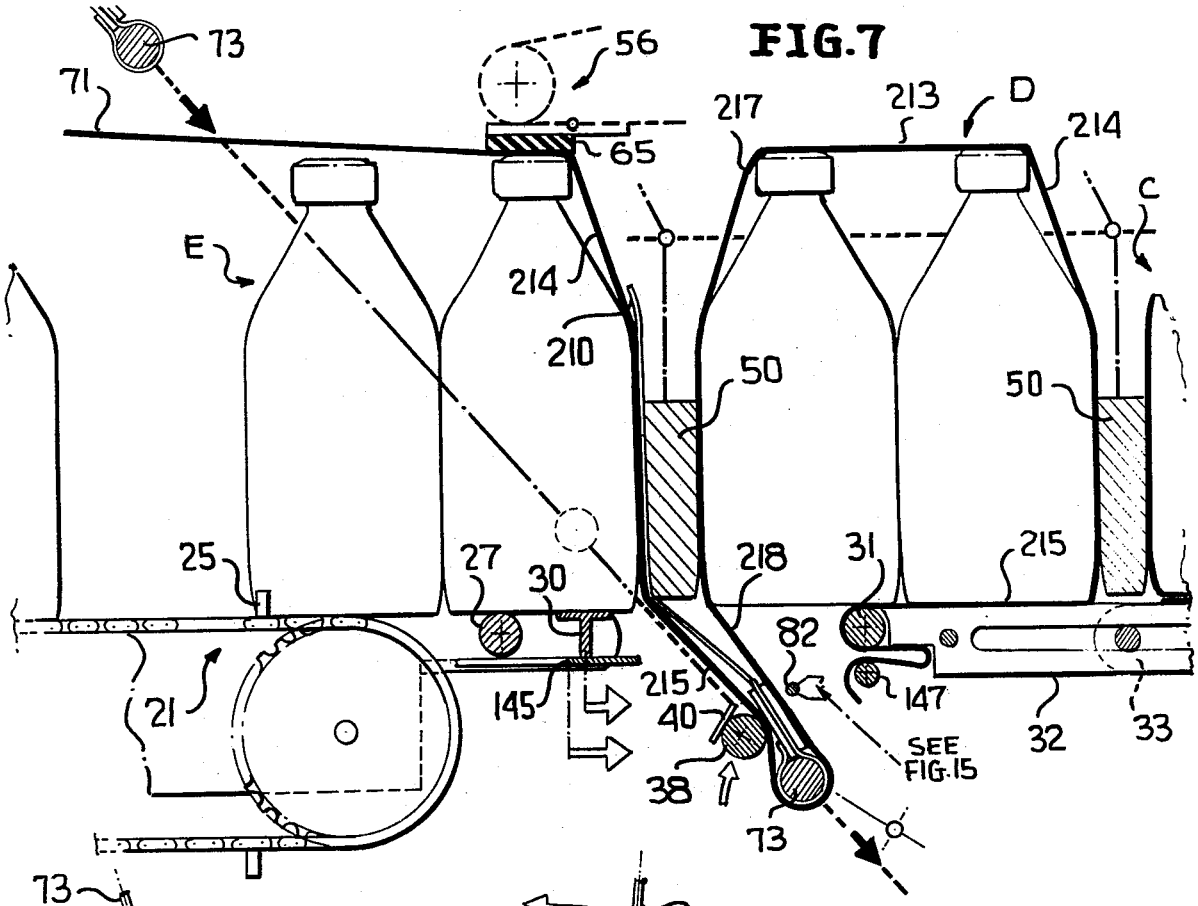
FIG. 7 is a diagrammatic view similar to FIG. 3 with the draw member in position 7 of FIG. 1.

Referring now to FIG. 7, it will be seen that the draw member 73 associated with the package D has moved down below the path of movement of the bottles a distance wherein the drawn web 71 between the bottles of package D and the bottles of package E is of a length to include a partial bottom panel 218 for the package D and the required substantially full bottom panel 215 for the package E. Further, the leading side panel 214 has been drawn for the package E. At this time the clamp pad 65 is just beginning to engage the web 71 in overlying relation with respect to the leading row of bottles of package E and the draw member 73 to be associated with package E is appearing on the seam above and to the left of the bottles of package E.

At this time the conveyor 21 and the power roll 27 have moved bottles of package E to a position substantially adjacent the push bar 50 for package D. At the same time, the rear support 30 and the tucker blade 145 have begun their movement to the right with the bottles of the leading row of bottles of package E being supported on the rear support 30 and the power roll 27. With respect to package D, it will be seen that the relationship of the bottles thereof with respect to the fingers 32 and the front support roll 31 remains substantially the same, the fingers 32 and the front support roll 31 moving to the right at substantially the same rate as package D.

The oscillating support 38 has moved up and engaged the under surface of the flag 210, more particularly the asbestos strip 212 on the underside thereof and functions as a support for the asbestos strip on the upperside of the flag. At this time the heated wire 182 is moving to the left and will engage the web 71 momentarily to cut the same.

Therefore, as is shown in FIG. 3 with respect to package C, the oscillating support 38 will move upwardly to move the flag 210 upwardly beneath the trailing row of bottles so as to wipe the partial bottom panel 218 under the trailing bottles and into a position for movement over the rear support roll 31. Then as package D moves to the right, as shown in FIG. 4 with respect to package C, the substantially full bottom panel 215 will be moved beneath the partial bottom panel 218.

Reference is here made once again to FIG. 1. It is to be noted that as each of the packages moves forwardly out of the wrapping area, it moves over the relatively fixed fingers 32 and the dead plate 34. As a result, the substantially full bottom panel 215 is drawn rearwardly while the opposite end of the cut web is held in place by both the trailing bottles being seated on the partial bottom panel 218 and the push bar 50 pushing against the trailing side panel 217. As a result, there is an automatic tightening of the package as the bottom panel is drawn rearwardly.

It will be readily apparent from the foregoing description of the operation of the machine that the draw members 73 serve solely to effect the drawing of the web down between adjacent units to be packaged and except for the supporting of the web at the time it is being cut, has no other function. As a result, the web drawing unit 74, with the exception of the auxiliary support unit 90, can be positioned entirely at one side of the machine 20. Further, it will be seen that operationally the web drawing unit 74 lies in a plane which extends transversely of the path of movement of the bottles and which slopes downwardly and to the right, when viewed in FIG. 1, for example.

When the draw members 73 have performed their functions, their straightline movement ceases and as the chain 76 passes around the sprockets 78, the draw member 73 swings in its plane down through the bottom portion of the frame of the machine 20 and up clear of the frame to one side thereof. The draw member moves upwardly while projecting away from the frame of the machine and then as the chain 76 passes around the sprocket 77, the draw member swings towards a vertical position and then down towards the path of movement of the bottles to repeat its straight-line movement down transversely of the path of bottles.

Because of the unique movement of the draw members 73, it is possible to modify the machine 20 to accommodate bottles or other articles of different heights by changing the angle of the plane in which the draw members 73 circulate. It is also possible to vary the speed of movement of the articles being packaged should this be desired by changing the angle of the slope of the plane in which the draw members 73 circulate.

Figure 17:
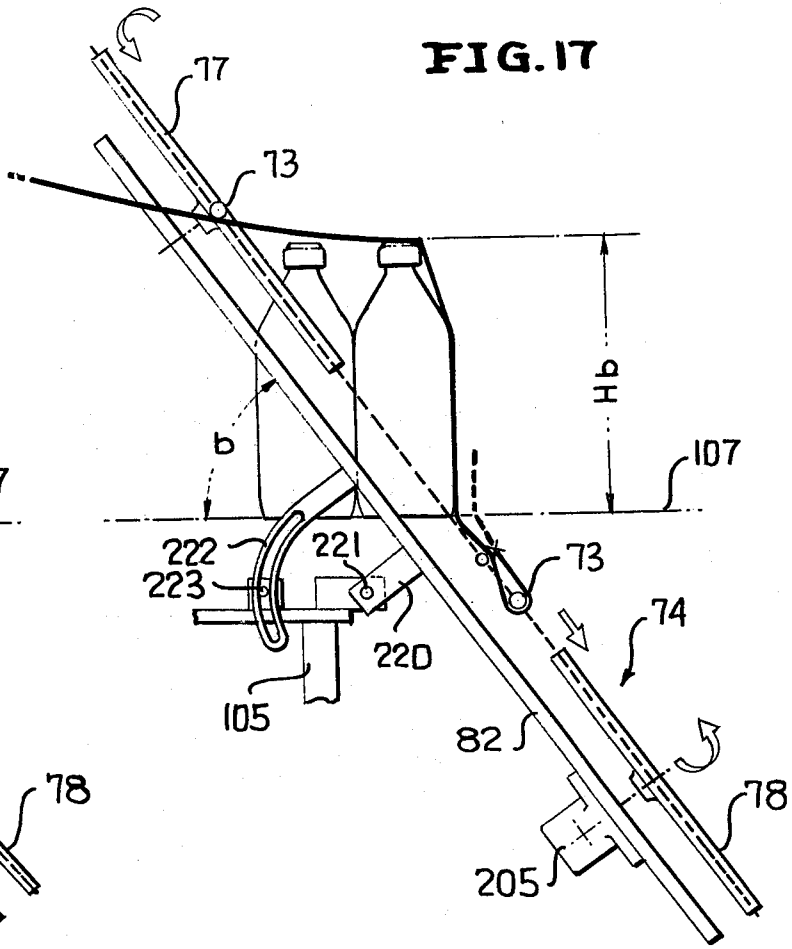
FIG. 17 is a schematic side elevational view similar to FIG. 16, but shows the web drawing means adjusted for use with like containers of a greater height.
Figure 16:
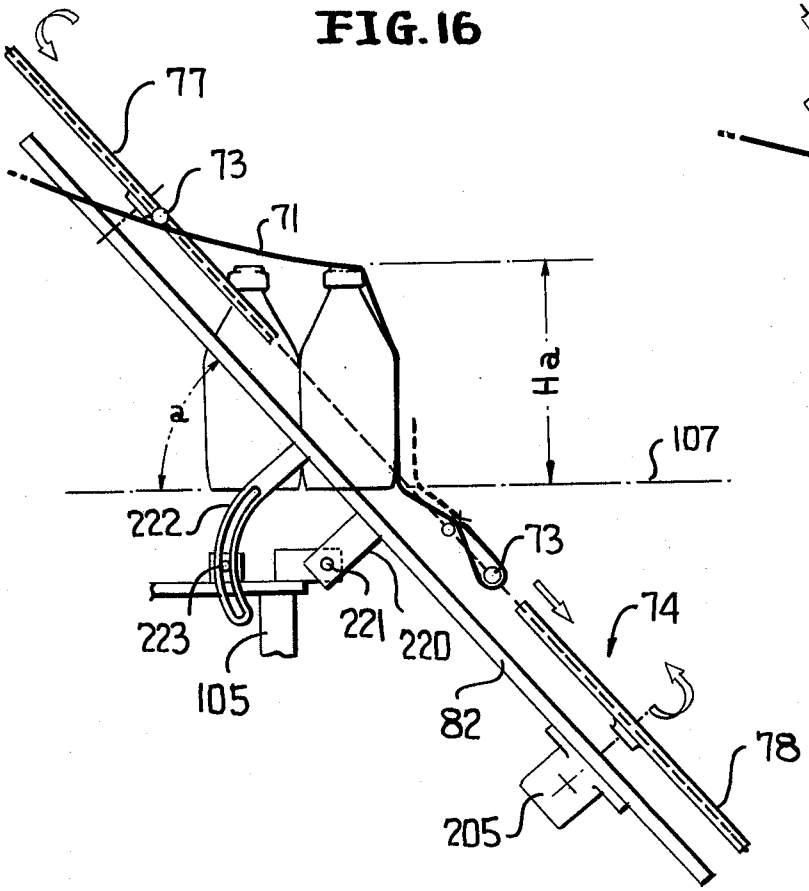
FIG. 16 is a schematic side elevational view showing the adjustable mounting of the web drawing means, the web drawing means being positioned with respect to containers of a first height.

With reference to FIGS. 16 and 17, it will be seen that the frame 82 of the web drawing unit 74 may be adjustably mounted on the machine frame 105. A typical mount may include a support bracket 220 which is connected to the frame 105 for pivotal movement by means of pivot 221. The frame 82 is retained in an adjusted annular position with respect to the frame 105 by means of a second support bracket 222 which is arcuate and slotted and is clamped relative to the frame 105 by means of a fastener 223 in an adjusted position.

It will be seen that for a predetermined movement of bottles to be packaged, the plane of the support frame 82 is set at an angle *a* with respect to the bottom of the path of bottle movement 107. When the web drawing unit 74 is so positioned, it is positioned for accommodating bottles having a height H*a*.

With reference to FIG. 17, when it is desired to utilize the machine 20 for packaging bottles having a height H*b*, which height is greater than the height H*a*, it is necessary to tilt the web drawing unit 74 so as to increase the angle between the plane thereof and the path of bottle movement to an angle *b*. When the web drawing unit 74 is set in this position, the draw member 73 will have sufficient time to move down between adjacent article units to be packaged in the same manner as that illustrated in FIG. 1 and described hereinbefore.

It is acknowledged that when the height of the articles being packaged is varied, certain adjustments will be required in the push bar unit 41 and the clamp unit 36. However, it will be readily apparent that the adjustments are minute as compared to completely retooling a machine to accommodate a different height article to be packaged.

As to the packaging of bottles and other articles of a larger transverse dimension, it will be apparent that certain adjustments will have to be made in the machine, such as adjusting the spacing of the push bar 50 and substituting a clamping unit having a different spacing between the pads 65.

Although only a preferred embodiment of the invention has been specifically illustrated and described herein, it is to be understood that minor variations may be made in the package forming machine without departing from the spirit and scope of the invention, as defined by the appended claims.

What is claimed as new:

1. A package forming machine comprising conveyor means for advancing articles to be packaged in units of at least one article each along a predetermined path with adjacent units in spaced relation, means for supplying a continuous web generally along said path above said units, and web drawing means for drawing said web down between each adjacent pairs of units in sequence to provide sufficient web for wrapping about the sides and bottom of each unit, said web drawing means including at least one draw member, and circulating means for circulating said draw member in a plane disposed transversely of said path, said plane sloping relative to said path in the direction of movement of articles along said path.

2. The machine of claim 1 wherein said circulating means include adjustable support means for varying the slope of said plane in accordance with variations in the height of units to be packaged.

3. The machine of claim 1 wherein said circulating means include adjustable support means for varying the slope of said plane in accordance with variations in the speed of movement of said conveyor means.

4. The machine of claim 1 wherein said circulating means include adjustable support means for varying the slope of said plane in accordance with variations in the height of units to be packaged and speed of movement of said conveyor means.

5. A package forming machine comprising conveyor means for advancing articles to be packaged in units of at least one article each along a predetermined path with adjacent units in spaced relation, means for supplying a continuous web generally along said path above said units, and web drawing means for drawing said web down between each adjacent pairs of units in sequence to provide sufficient web for wrapping about the sides and bottom of each unit, said web drawing means including at least one draw member, and circulating means for circulating said draw member in a plane disposed transversely of said path, there being a plurality of said draw members, said circulating means including an endless conveyor member, and said conveyor member having support means for said draw members at regularly spaced intervals.

6. The machine of claim 5 together with auxiliary support means for said draw member disposed at the opposite side of said path.

7. The machine of claim 6 wherein said auxiliary support means includes at least one auxiliary support circulating in a plane parallel to said path.

8. The machine of claim 7 wherein said auxiliary supports are carried by an endless conveyor, said auxiliary support being formed in two parts separately mounted on said endless conveyor, and said endless conveyor having at least two arcuate path portions to effect opening and closing relative movements of said auxiliary support in timed relation to movement of the draw member transversely of said path.

9. A package forming machine comprising conveyor means for advancing articles to be packaged in units of at least one article each along a predetermined path with adjacent units in spaced relation, means for supplying a continuous web generally along said path above said units, and web drawing means for drawing said web down between each adjacent pairs of units in sequence to provide sufficient web for wrapping about the sides and bottom of each unit, said web drawing means including at least one draw member, and circulating means for circulating said draw member in a plane disposed transversely of said path, said draw member including a trailing flag for maintaining separate adjacent drawn portions of said web.

10. A package forming machine comprising conveyor means for advancing articles to be packaged in units of at least one article each along a predetermined path with adjacent units in spaced relation, means for supplying a continuous web generally along said path above said units, and web drawing means for drawing said web down between each adjacent pairs of units in sequence to provide sufficient web for wrapping about the sides and bottom of each unit, said web drawing means including at least one draw member, and circulating means for circulating said draw member in a plane disposed transversely of said path, cutter means cooperable with said drawn member to transversely cut that portion of the web drawn down between two adjacent units, said cutter means being in the form of a heated wire and said drawn member includes a heat resistant surface, said heat resistant surface being defined by a trailing web of heat resistant material.

11. The machine of claim 10 wherein said conveyor means includes an oscillating support movable between a retracted position and an operative position, and said oscillating support forming a temporary backing for said trailing web at the time of operation of said cutter means.

12. A package forming machine comprising conveyor means for advancing articles to be packaged in units of at least one article each along a predetermined path with adjacent units in spaced relation, means for supplying a continuous web generally along said path above said units, and web drawing means for drawing said web down between each adjacent pairs of units in sequence to provide sufficient web for wrapping about the sides and bottom of each unit, said web drawing means including at least one draw member, and circulating means for circulating said draw member in a plane disposed transversely of said path, cutter means cooperable with said draw member to transversely cut that portion of the web drawn down between two adjacent units to define a rear panel and a short bottom panel for a leading unit and a front panel and a substantially full bottom panel for a trailing unit, means for moving a trailing portion of a bottom panel for the leading unit to an out of the way position, means for moving the short bottom panel for the leading unit into engagement with the underside of the leading unit, and means for holding the short bottom panel for the leading unit against the bottom of the leading unit while progressively moving the trailing portion of the bottom panel for the leading unit against the underside of the associated short bottom panel.

13. The machine of claim 12 wherein said conveyor means includes a support on which a wrapped unit slides, and a pusher engageable with a wrapped unit rear panel to effect sliding of a wrapped unit over said support to effect a rearward drawing of the bottom panel of the wrapped panel and a tightening of the resultant package.

14. The machine of claim 13 wherein said means for moving the short bottom panel is in the form of a roller forming part of said support.

15. A package forming machine comprising conveyor means for advancing articles to be packaged in units of at least one article each along a predetermined path with adjacent units in spaced relation, means for supplying a continuous web generally along said path above said units, and web drawing means for drawing said web down between each adjacent pairs of units in sequence to provide sufficient web for wrapping about the sides and bottom of each unit, each web drawing means including at least one draw member, and circulating means for circulating said draw member in a plane disposed transversely of said path, cutter means cooperable with said draw member to transversely cut that portion of the web drawn down between two adjacent units, and clamp means for clamping the web against the top of a trailing unit for retaining the web in fixed relation to the trailing unit after the web has been cut, said clamp means including at least one clamp member, and support means for circulating said clamp member in a continuous pattern over said path in an orientation transversely thereof.

16. The machine of claim 15 wherein said continuous pattern includes a portion disposed parallel to said path.

17. The machine of claim 15 wherein said conveyor means includes at least one push bar, drive means for circulating said push bar in a continuous pattern including a portion extending along said path with said push bar being oriented transversely of said path.

18. The machine of claim 17 wherein the pattern of said push bar encircles the pattern of the clamp member.

19. The machine of claim 17 wherein the timing of movement of said draw member and said push bar is one wherein said push bar closely follows said draw member between adjacent units.

20. The machine of claim 17 wherein said push bar is of an elongated section longitudinally of said path, and said push bar is vertically oriented along said portion of its pattern with the dimension of said push bar longitudinally of said path determining the spacing between adjacent packages.

21. A package forming machine comprising conveyor means for advancing articles to be packaged in units of at least one article each along a predetermined path with adjacent units in spaced relation, means for supplying a continuous web generally along said path above said units, and web drawing means for drawing said web down between each adjacent pairs of units in sequence to provide sufficient web for wrapping about the sides and bottom of each unit, said web drawing means including at least one draw member, and circulating means for circulating said draw member in a plane disposed transversely of said path, said conveyor means including at least one push bar, and drive means for circulating said push bar in a continuous pattern including a portion extending along said path with said push bar being oriented transversely of said path.

22. The machine of claim 21 wherein the timing of movement of said draw member and said push bar is one wherein said push bar closely follows said draw member between adjacent units.

23. The machine of claim 21 wherein said push bar is of an elongated section longitudinally of said path, and said push bar is vertically oriented along said portion of its pattern with the dimension of said push bar longitudinally of said path determining the spacing between adjacent packages.

24. A package forming machine comprising conveyor means for advancing articles to be packaged in units of at least one article each along a predetermined path with adjacent units in spaced relation, means for supplying a continuous web generally along said path above said units, and web drawing means for drawing said web down between each adjacent pairs of units in sequence to provide sufficient web for wrapping about the sides and bottom of each unit, said web drawing means including at least one draw member, and circulating means for circulating said draw member in a plane disposed transversely of said path, said conveyor means including at least a pair of movable supports underlying said path, drive means for reciprocating said two supports longitudinally of said path, and the movements of said two supports being such that at least at the time said draw member traverses said path at the plane of said two supports said two supports are longitudinally separated by a transverse space, and said transverse space being in alignment with said draw member for the passage thereof through said transverse space.

25. The machine of claim 24 wherein said drive means are operative to vary the position of said space along said path.

26. The machine of claim 24 wherein said drive means are operative to vary the longitudinal dimension of said space.

27. The machine of claim 24 wherein the drive means are operative to vary the longitudinal dimension of said space, and there is a third support movable into said space in timed relation to the transfer of articles over said space to facilitate the supporting of articles.

28. The machine of claim 27 wherein said third support is carried by oscillating support means, and said third support is mounted for movement longitudinally of said path relative to the article being packaged for moving a portion of said web under the article.

* * * * *